US007774953B1

(12) United States Patent
Duran

(10) Patent No.: US 7,774,953 B1
(45) Date of Patent: Aug. 17, 2010

(54) ATHLETE HAND DRYING SYSTEM

(76) Inventor: Napoli I. Duran, 13745 Via Del Palma Ave., Apt. 31, Whittier, CA (US) 90602-2332

( * ) Notice: Subject to any disclaimer, the term of this patent is extended or adjusted under 35 U.S.C. 154(b) by 546 days.

(21) Appl. No.: 11/754,245

(22) Filed: May 25, 2007

(51) Int. Cl.
*F26B 21/06* (2006.01)

(52) U.S. Cl. ..... 34/77; 34/86; 34/90; 34/103; 34/104; 34/107; 34/202; 34/209; 34/218; 422/28; 422/37; 424/421; 134/28.4; 239/54

(58) Field of Classification Search ..... 34/77, 34/86, 90, 103, 104, 107, 202, 209, 218, 34/242; 422/28, 37; 134/28.4; 239/54; 424/421
See application file for complete search history.

(56) References Cited

U.S. PATENT DOCUMENTS

| | | | | | |
|---|---|---|---|---|---|
| 874,072 | A | | 12/1907 | Holl | |
| 1,381,436 | A | * | 6/1921 | Savy | 34/193 |
| 1,577,859 | A | * | 3/1926 | Woodard | 239/282 |
| 1,918,927 | A | * | 7/1933 | Otto | 34/202 |
| 1,961,179 | A | * | 6/1934 | Tinkham | 34/202 |
| 1,997,387 | A | * | 4/1935 | McCord | 34/202 |
| 2,383,474 | A | * | 8/1945 | Denner | 34/105 |
| 2,389,822 | A | * | 11/1945 | Simmons | 34/202 |
| 2,438,762 | A | * | 3/1948 | McLeckie | 34/87 |
| 2,488,266 | A | | 11/1949 | Brenn | |
| 2,490,019 | A | * | 12/1949 | Elliot | 34/202 |
| 2,634,514 | A | * | 4/1953 | Clemens | 34/202 |
| 2,646,629 | A | * | 7/1953 | Clemens | 34/202 |
| 2,698,894 | A | * | 1/1955 | Stein | 392/380 |
| 2,761,222 | A | * | 9/1956 | Bennett | 34/202 |
| 2,853,591 | A | * | 9/1958 | Fine | 392/381 |
| 2,853,592 | A | * | 9/1958 | Gravet | 422/243 |
| 2,859,535 | A | * | 11/1958 | Carlson | 34/562 |
| D185,490 | S | * | 6/1959 | Cota | D28/54.1 |
| 2,965,974 | A | * | 12/1960 | Jackson | 34/225 |
| 2,991,560 | A | * | 7/1961 | Cota | 34/87 |
| 3,060,472 | A | * | 10/1962 | Horton | 15/4 |
| 3,076,887 | A | * | 2/1963 | Bulow | 392/381 |
| 3,193,869 | A | * | 7/1965 | Coppock, Jr. | 401/200 |
| 3,603,002 | A | * | 9/1971 | Spierer | 34/202 |
| 3,606,319 | A | * | 9/1971 | Borden | 473/61 |
| 3,643,346 | A | * | 2/1972 | Lester | 34/202 |
| 3,667,134 | A | * | 6/1972 | Rockson | 34/60 |
| 3,689,735 | A | * | 9/1972 | McLeod et al. | 219/215 |
| 3,744,149 | A | * | 7/1973 | Helbling | 34/202 |
| 3,766,397 | A | * | 10/1973 | Rockson | 250/432 R |

(Continued)

FOREIGN PATENT DOCUMENTS

DE 3443439 A1 * 5/1986

(Continued)

*Primary Examiner*—Stephen M. Gravini

(57) ABSTRACT

Disclosed is a system to dry the hands of individuals. The system may include a pedestal, an air pedal and powder pedal hinged to the pedestal, a chamber having a dome connected to a shroud to define a chamber interior. The chamber interior may be divided into a first divided area, a second divided, and an overhead area that connects the first divided area to the second divided area. Each dived area may include a perforated tube to deliver pressurized air and powder into the chamber interior. An air compressor may be connected directly to the perforated tubes and connected to a powder chamber. In addition to pressurized air being delivered to the chamber interior, powder optionally may be delivered to the chamber interior.

14 Claims, 4 Drawing Sheets

U.S. PATENT DOCUMENTS 3,930,320 A * 1/1976 Henderson ..... 34/202
4,006,094 A * 2/1977 Pellar ..... 252/194
4,055,002 A * 10/1977 Roberts et al. ..... 34/104
4,087,925 A * 5/1978 Bienek ..... 34/60
4,138,827 A * 2/1979 Baugh et al. ..... 34/98
4,195,416 A * 4/1980 Hall ..... 34/90
4,383,377 A * 5/1983 Crafton ..... 34/60
4,448,560 A * 5/1984 Monaco, Jr. ..... 401/200
4,572,690 A * 2/1986 Savanuck ..... 401/200
4,642,909 A * 2/1987 Garcia ..... 34/97
4,659,494 A * 4/1987 Soldanski et al. ..... 8/142
4,665,630 A * 5/1987 Postbeschild ..... 34/566
4,682,422 A * 7/1987 Harris ..... 34/333
4,754,769 A * 7/1988 Flynn ..... 132/73.5
4,756,094 A * 7/1988 Houck, Jr. ..... 34/225
4,785,162 A * 11/1988 Kuo ..... 392/381
4,878,602 A 11/1989 Weigelt
4,896,833 A 1/1990 Brody
4,914,833 A * 4/1990 Pilolla et al. ..... 34/526
4,993,172 A * 2/1991 Allen ..... 34/202
4,999,929 A * 3/1991 Dutton ..... 34/90
5,014,360 A * 5/1991 Smith et al. ..... 2/115
5,031,337 A * 7/1991 Pilolla et al. ..... 34/526
5,111,594 A * 5/1992 Allen ..... 34/266
5,146,695 A * 9/1992 Yang ..... 34/90
5,163,234 A * 11/1992 Tsukamoto et al. ..... 34/487
5,364,464 A * 11/1994 Sereboff ..... 106/36
5,409,536 A 4/1995 Dimler
5,459,944 A * 10/1995 Tatsutani et al. ..... 34/202
5,491,908 A * 2/1996 Ruiz et al. ..... 34/202
5,565,023 A * 10/1996 Sereboff ..... 106/36
5,877,138 A * 3/1999 Ditze et al. ..... 510/280
5,974,685 A * 11/1999 Hironaka ..... 34/202
6,038,786 A * 3/2000 Aisenberg et al. ..... 34/267
6,050,000 A * 4/2000 Curzon ..... 34/572
6,116,480 A 9/2000 Dufont
6,129,636 A * 10/2000 Tuten et al. ..... 473/102
6,171,006 B1 * 1/2001 Woodall ..... 401/200
6,185,838 B1 * 2/2001 Moore ..... 34/202
6,189,230 B1 * 2/2001 Huen ..... 34/90
6,349,414 B1 * 2/2002 Tillman ..... 2/170
6,766,589 B1 * 7/2004 Bory et al. ..... 34/90
6,769,197 B1 * 8/2004 Tai ..... 34/90
7,039,301 B1 * 5/2006 Aisenberg et al. ..... 392/380
7,555,209 B2 * 6/2009 Pradas Diez et al. ..... 392/380
7,596,883 B2 * 10/2009 Kameishi ..... 34/90
2006/0000110 A1 * 1/2006 Aisenberg et al. ..... 34/443
2006/0201015 A1 * 9/2006 Russell ..... 34/90
2007/0068031 A1 * 3/2007 Dascher ..... 34/233
2007/0079524 A1 * 4/2007 Sato et al. ..... 34/202
2007/0094884 A1 * 5/2007 Micheludis ..... 34/107
2008/0052952 A1 * 3/2008 Nelson ..... 34/554
2008/0209760 A1 * 9/2008 French et al. ..... 34/585
2008/0216342 A1 * 9/2008 Kameishi et al. ..... 34/202
2008/0216344 A1 * 9/2008 Churchill et al. ..... 34/202
2008/0222910 A1 * 9/2008 Churchill et al. ..... 34/202
2008/0263889 A1 * 10/2008 Fukaya et al. ..... 34/267
2008/0301970 A1 * 12/2008 Hackwell et al. ..... 34/202
2008/0313918 A1 * 12/2008 Dyson et al. ..... 34/202
2008/0313919 A1 * 12/2008 Churchill et al. ..... 34/202
2009/0034946 A1 * 2/2009 Caine et al. ..... 392/380
2009/0113746 A1 * 5/2009 Churchill et al. ..... 34/202
2009/0113748 A1 * 5/2009 Dyson et al. ..... 34/232

FOREIGN PATENT DOCUMENTS

EP 329171 A1 * 8/1989
GB 2085725 A * 5/1982
JP 05049553 A * 3/1993

* cited by examiner

ATHLETE HAND DRYING SYSTEM

BACKGROUND

1. Field

The information disclosed relates to a system to dry the hands of athletes.

2. Background Information

Many sports require athletes to use their hands to perform. For example, football players use their hands to catch a football, basketball players use their hands to handle a basketball, gymnast use their hands to move themselves about gymnastic equipment, and tennis players use their hands to handle a tennis racket. In each situation, the athlete relies on good friction from their hands to manipulate the hand equipment.

When athletes exert themselves, their bodies sweat to help regulate its temperature. As the athletes muscles heat up due to exertion, more sweat is produced. Eccrine sweat glands are distributed over the entire body surface but are particularly abundant on the palms of hands. Thus, an athlete's hands are likely to produce a significant amount of sweat. Since sweat reduces a hand's friction, the athletes may have less control over hand equipment. Thus, there is a need for a system to dry an athlete's hands to allow him or her to perform better.

SUMMARY

Disclosed is a system to dry the hands of individuals. The system may include a pedestal, an air pedal and powder pedal hinged to the pedestal, a chamber having a dome connected to a shroud to define a chamber interior. The chamber interior may be divided into a first divided area, a second divided, and an overhead area that connects the first divided area to the second divided area. Each dived area may include a perforated tube to deliver pressurized air and powder into the chamber interior. An air compressor may be connected directly to the perforated tubes and connected to a powder chamber. In addition to pressurized air being delivered to the chamber interior, powder optionally may be delivered to the chamber interior.

DETAILED DESCRIPTION

Figure 1:
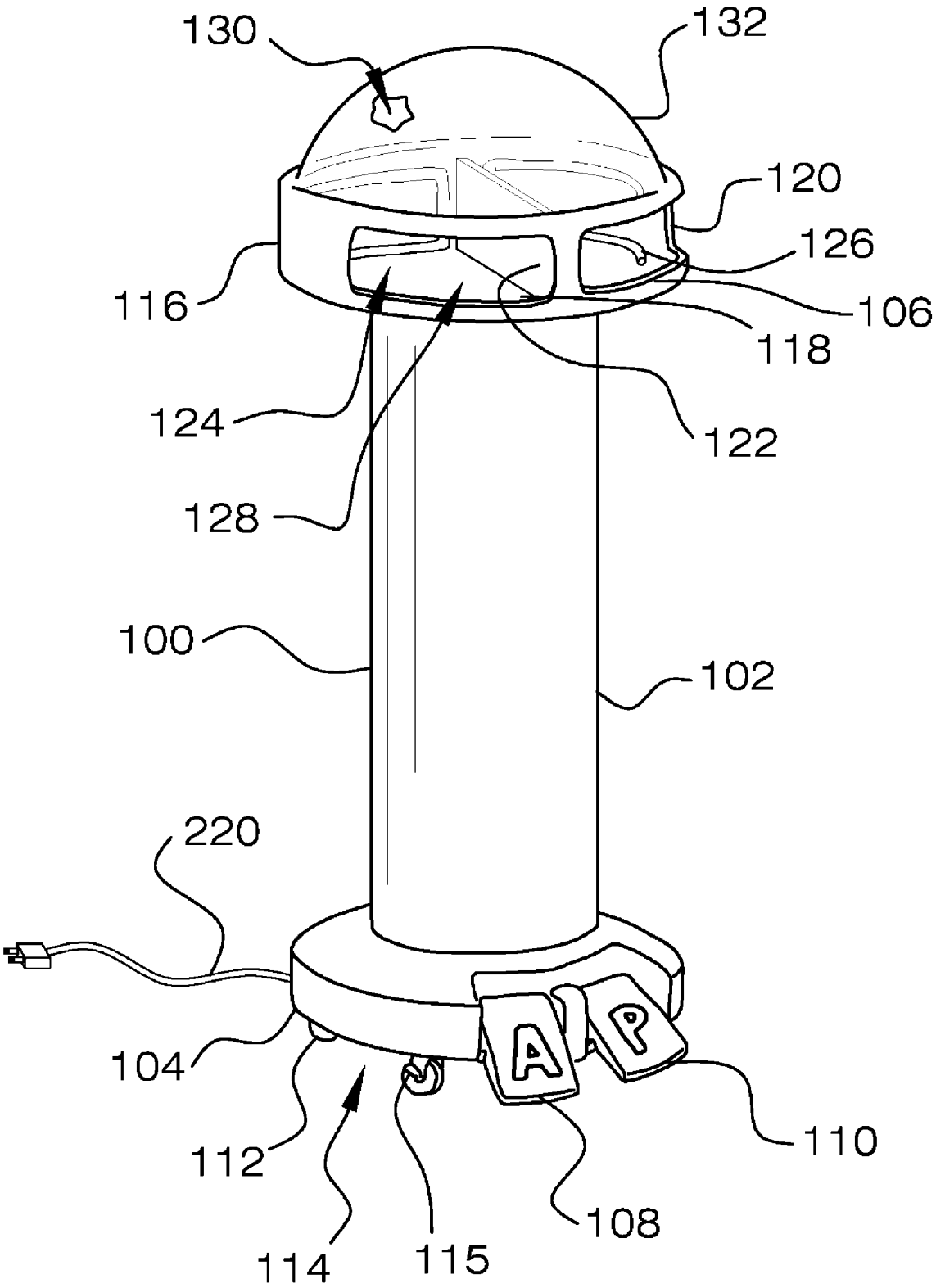
FIG. 1 is an isometric view of a system 100 to dry the hands of athletes.

FIG. 1 is an isometric view of a system 100 to dry the hands of athletes. The system may include a tower 102 positioned between a pedestal 104 and a chamber 106. Compressed air generated near the pedestal 104 may be passed through tower 102 into chamber 106 to permit an athlete to dry their hands.

Tower 102 may be an elongated, hollow cylinder. Pedestal 104 may be a hollow, cylindrical base configured to support tower 102. Hinged to pedestal 104 may be an air pedal 108 and a powder pedal 110 positioned to the right of air pedal 108. In addition, casters 112 may be attached to a bottom 114 of pedestal 104. Each of air pedal 108 and powder pedal 110 may be spring loaded levers that may be operated by a human foot. Air pedal 108 may include a large "A" on a visible surface and powder pedal 110 may include a large "P" on a visible surface to distinguish the operation of each pedal.

Casters 112 may be small, pivoted wheels fastened to pedestal 104 to facilitate movement of system 100 from one location to another. Each caster 112 may include a locking brake 115 that, when engaged, may keep system 100 stationary. In one example, there may be four casters 112.

Chamber 106 may be a hollow, semi-enclosed area where an athlete may dry that athlete's hands. Chamber 106 may include a shroud 116 having a left hand hole 118, a right hand hole 120, and a partition 122 that may provide a first divided area 124 and a second divided area 126 within chamber 106 that may correspond with left hand hole 118 and right hand hole 120. Shroud 116 may include an annulus shape to assist in directing air flow towards the athlete's hands. Left hand hole 118 and right hand hole 120 each may be rectangular openings in shroud 116 positioned above air pedal 108 and powder pedal 110. These openings may permit an individual to place that individual's hands within chamber 106

Partition 122 may be a vertical structure that may divide a chamber interior 128 into a three-part dispenser environment: first divided area 124, second divided area 126, and an overhead area 130 that may connect first divided area 124 to second divided area 126. Partition 122 may assist in directing individual air flow towards each of the athlete's hands while overhead area 130 may communicate air flow from a higher air flow divided area to a lower air flow divided area. In one example, a height of partition 122 may be at least one of greater than and equal to a height of shroud 116. In another example, a height of partition 122 may be at least one of less than and equal to a height of shroud 116.

To contain air flows within chamber 106, chamber 106 additionally may include a dome 132. Dome 132 may be a concave shape where the concavity faces downward. In one example, dome 132 may be clear. In another example, dome 132 may be translucent. Dome may be made of plastic or glass and within dome 132 may be overhead area 130.

Figure 2:
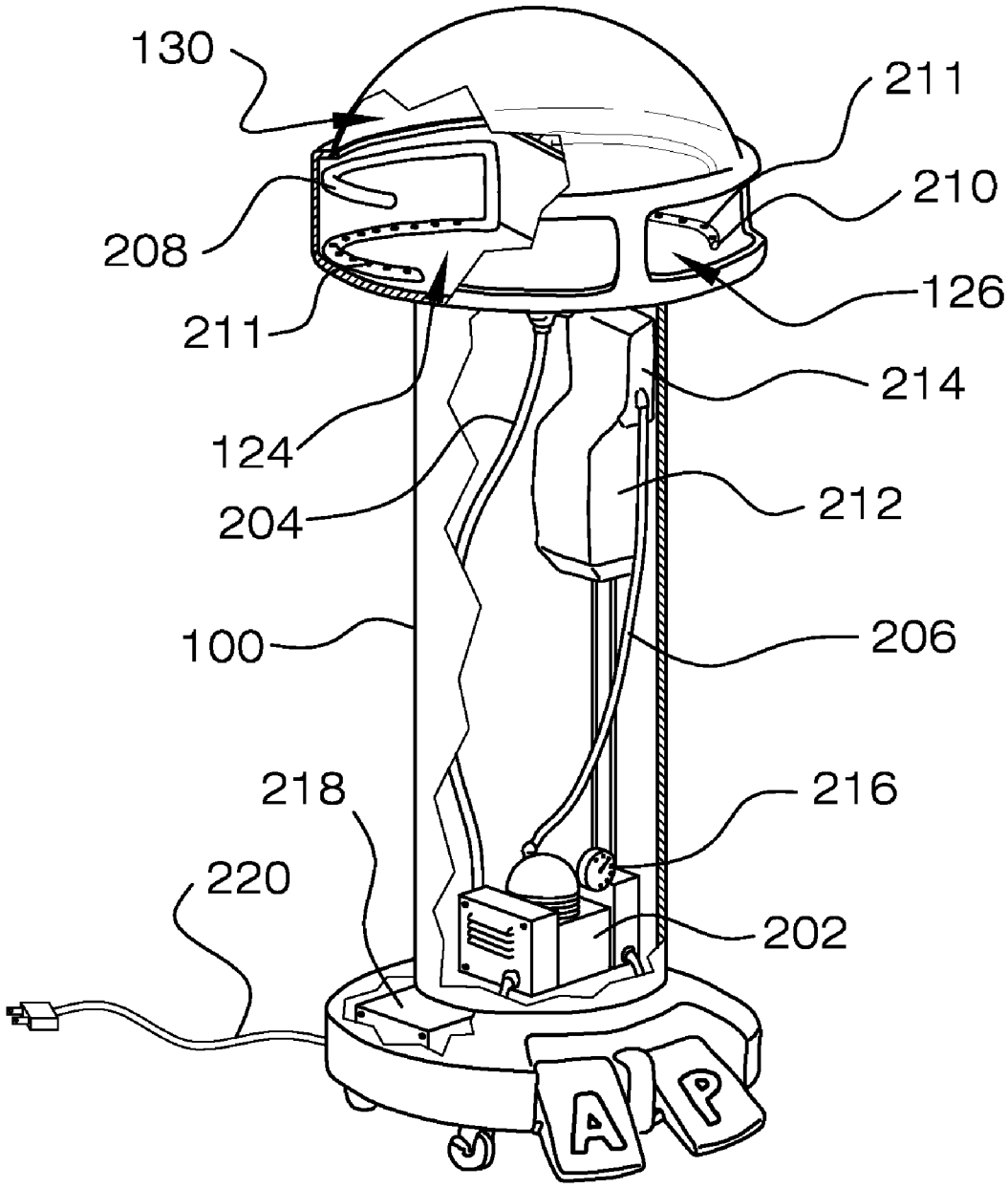
FIG. 2 is a partial sectional isometric view of system 100.

FIG. 2 is a partial sectional isometric view of system 100. System 100 additionally may include an air compressor 202. Air compressor 202 may be a machine that compresses and directs air into a first air hose 204 and a second air hose 206. In once example, air compressor 202 may be a ½-horsepower air compressor. First air hose 204 and second air hose 206 each may be ¼-inch diameter flexible hoses. Air compressor 202 may be connected to air pedal 108 and powder pedal 110. When pressed, air pedal 108 may direct air compressor 202 to blow air into first air hose 204. When powder pedal 110 is pressed, air compressor 202 may blow air into second air hose 206.

System 100 further may include a left tube 208 and a right tube 210. Left tube 208 may be positioned within first divided area 124 and right tube 210 may be positioned within second divided area 126. Each of left tube 208 and right tube 210 may be hollow cylindrical conduits having holes or perforations 211 distributed along its length and configured to pass air and powder from an entrance through its interior and out through holes 211.

Each of left tube 208 and right tube 210 may have a U-shape when viewed from a first direction and a semi-circular shape when view from ninety degrees to that first direction. Left tube 208 and right tube 210 may be interchangeable in that left tube 208 may be positioned within second divided area 126 and right tube 210 may be positioned within first divided area 124. Both left tube 208 and right tube 210 may be connected to first air hose 204 to receive high pressured air from first air hose 204.

System 100 also may include a powder container 212, an air regulator 214, a pressure gage 216, an electrical box 218, and a power cord 220. Second air hose 206 may be connected to powder container 212 and powder container 212 may be connected to air regulator 214. In turn, air regulator 214 may be connected to both left tube 208 and right tube 210. Pressure gage 216 and electrical box 218 may be connected to air compressor 202 and power cord 220 may be connected to electrical box 218.

Powder container 212 may be configured to hold powder, such as talcum powder, that may be utilized to keep hands dry. Air regulator 214 may assist in controlling the air pressure that leaves powder container 212. Second air hose 206 may direct a flow of air into contact with powder in powder container 212 so that the air picks up powder and carries it through air regulator 214 and into left tube 208 and right tube 210. Too much air pressure may cause excess talcum powder to be blasted out of powder container 212. Thus, it may be important to regulate the air pressure that leaves powder container 212.

Pressure gage 216 may be a device to measure the air pressure being produced by air compressor 202. Electrical box 218 may be 110-volt electrical box contained within pedestal 102. Leading from electrical box 218 to an exterior of the system may be power cord 220. Power cord 220 may be plugged into an electrical outlet.

Figure 3:
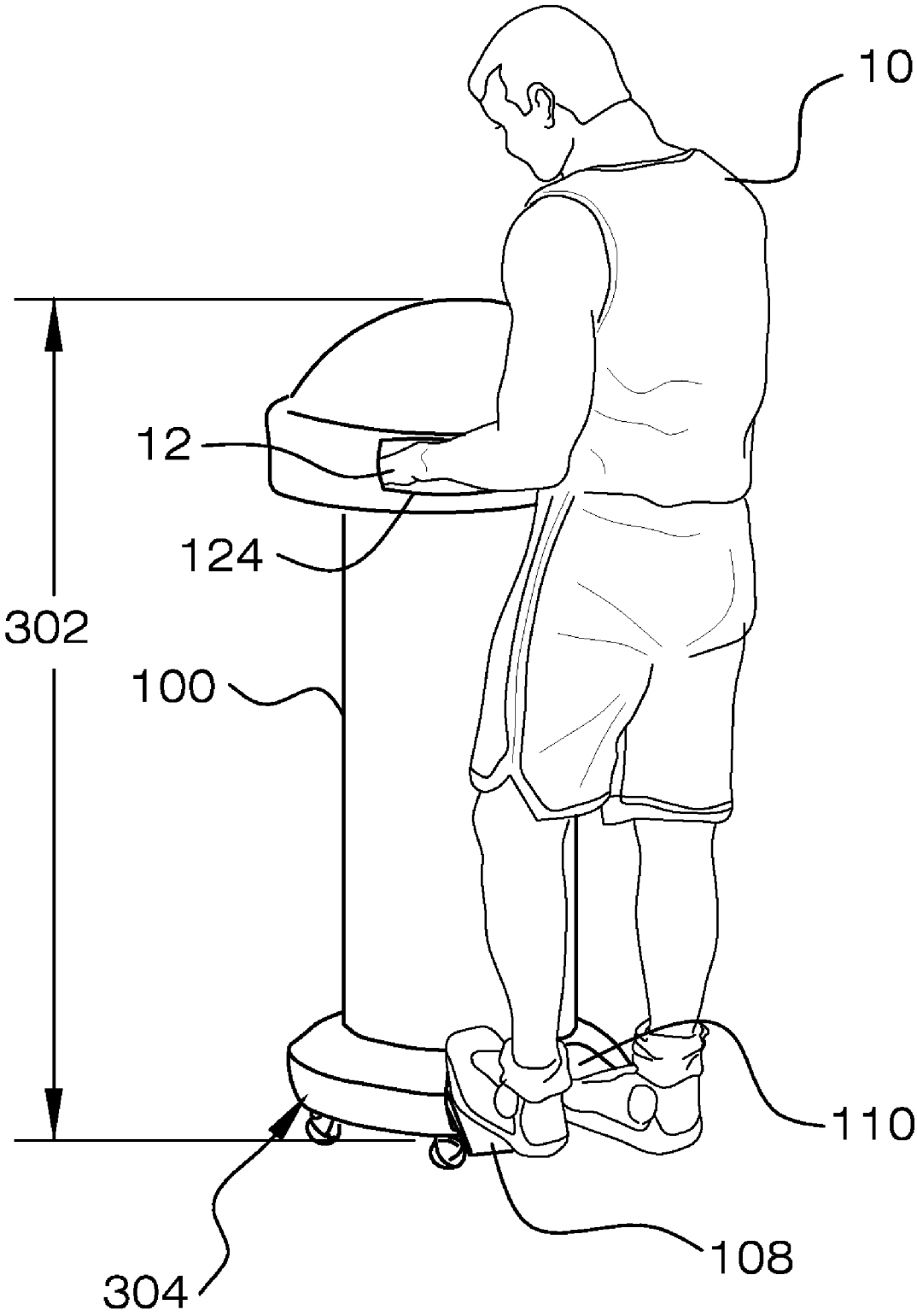
FIG. 3 is an example of a use of system 100 by a player 10.
Figure 4:
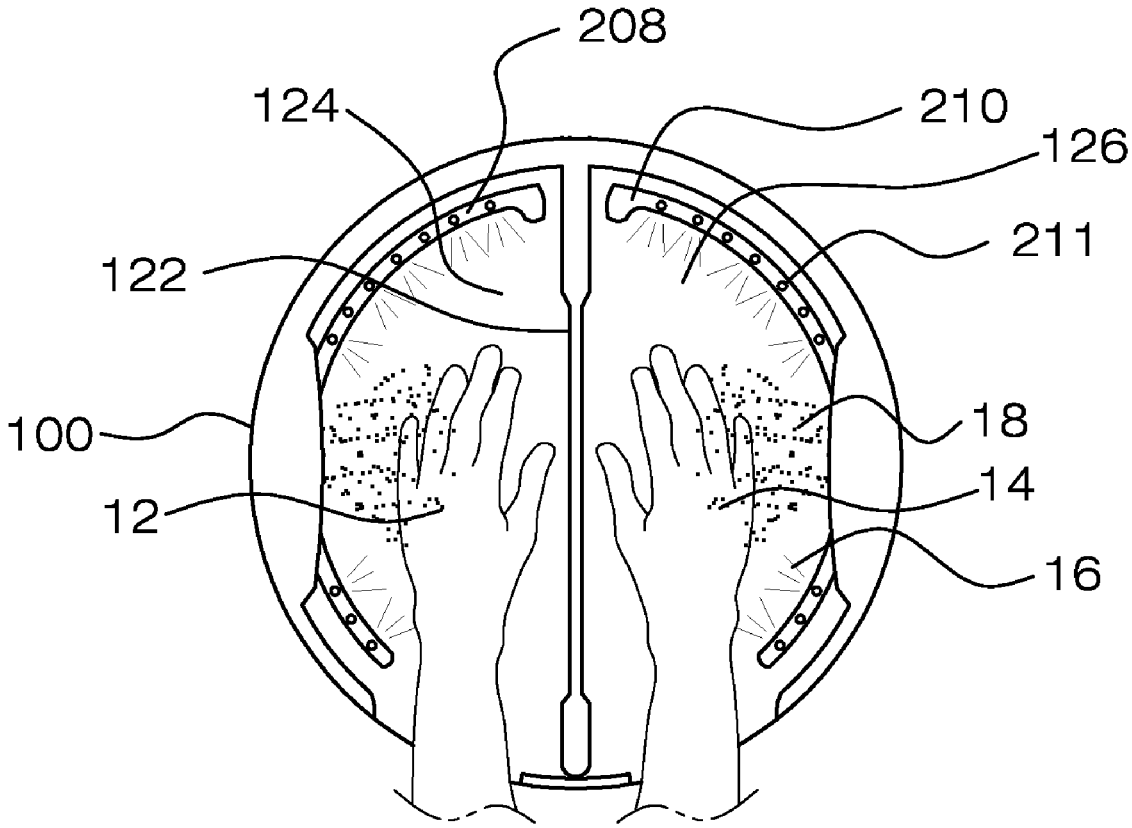
FIG. 4 is a top partial section view of a use of system 100.

FIG. 3 is an example of a use of system 100 by a player 10. FIG. 4 is a top partial section view of a use of system 100. System 100 may have a height 302 and a diameter 304. In one example, height 302 may be approximately three to four feet tall and diameter 304 may be approximately twelve to eighteen inches in diameter. In another example, height 302 may be approximately three to six feet tall to account for the great height of basketball players.

To use system 100, player 10 may place a left hand 12 into first divided area 124 and a right hand 14 into second divided area 126. By stepping on air pedal 108, player 10 may activate air compressor 202 and cause air compressor 202 to blow a forceful stream of air through first air hose 204 and into left tube 208 and right tube 210. Air 16 (FIG. 4) may exit perforations 211 in tubes 208, 210 to strike the user's hands 12, 14, respectively. This may help evaporate sweat and moisture. If so desired, player 10 may also depress powder pedal 110. This would cause air compressor 202 to blow a forceful stream of air through second air hose 206. This air may then impact the powder within powder container 212 to draw powder 18 with it as the air passes through air regulator 214. This powder 18 may pass through and out of tubing 208, 210 within shroud 116 and onto the individual's hands 12, 14.

The system to dry the hands of athletes may be equipment for basketball teams, football teams, and tennis facilities. The system may provide an effective means of drying an athlete's hands, which may allow him or her to perform better. Using the system periodically during a sport activity may help keep a person's hands dry, which may ultimately enhance performance.

The system may include a cylindrical or silo shaped housing measuring approximately 3 to 4 feet tall and approximately 12 to 18 inches in diameter. The top of the unit may feature a clear, dome-shaped housing complete with a pair of rectangular openings on its lower front perimeter. These openings may allow an individual to place his hands within the unit. Two perforated metal tubes may be affixed around the interior perimeter of the unit's dome-shaped housing. Each tube may be connected to flexible ¼-inch diameter hose. One hose may be connected to a ½-horsepower air compressor located in the bottom of the system. The other may engage with an air regulator and powder dispenser assembly located near a top of the system. The powder dispenser may then be connected to the air compressor via an additional length of ¼-inch hose.

The air compressor may feature a dual-output design and may be wired to two pedal-style controls on the lower exterior of the unit. The left pedal may activate the air compressor, which may blow air through the tubing within the dome at the top of the unit. The right pedal may also activate the air compressor and may send a blast of air into the powder container. The powder may travel through the air regulator and may be dispensed within the dome via the other section of tubing. The air compressor may also be wired to a 110-volt electrical box contained within the bottom of the assembly. Leading from this box to the exterior of the unit may be a standard power cord, which may be plugged into an electrical outlet. Wheels may also be featured on the underside of the system and may allow the unit to be moved from place to place. Each wheel may also feature a locking brake, which may be applied to keep the unit stationary.

The system may be produced in different sizes for different applications. To use the system, an individual may place his hands through the openings at a top of the unit and into the clear dome. He may then step down on the left pedal at the bottom of the unit. This may activate the air compressor, which may blow a forceful stream of air through the tubing within the dome. The air may exit the perforations on the tube and strike the user's hands, which may help evaporate sweat and moisture. If so desired, the user may also depress the right pedal at the bottom of the unit. This may dispense a blast of talcum powder through the tubing within the dome and onto the individual's hands.

The system may fulfill a need for a device that may be utilized to dry an athlete's hands during a sports activity. Appealing features of the system may be its ease of use, portability, convenience, and ability to enhance performance among athletes. The system may provide a contained air blower that may allow an athlete to dry his or her hands during a sport activity. An individual may simply place his hands within the dome at the top of the unit and step on one of the pedals at the bottom of the device. This may release a continual blast of air into the dome, which may provide an effective means of drying the user's hands.

This may be particularly ideal for evaporating perspiration from an athlete's hands during a game or match. Using the system periodically may help the hands remain dry, which in turn may ensure the player may maintain a slip-free grip on a ball or piece of sports equipment. In this regard, the system may be particularly useful among athletes who play basketball, football, and tennis, as it may enhance performance.

In addition to drying hands, an athlete may use the system to apply talcum powder to his or her hands. Applying powder may provide an effective means of keeping an individual's hands dry for longer periods of time, which, again, may enhance performance. Since the system may dispense powder via an air compressor and system of tubing, it may provide a more even means of applying powder to the hands than can be achieved by dispensing powder from a bottle or another container. This may ensure the powder did not clump together on the user's hands and may thus prevent waste.

While the end users of the system may be athletes, the device may be utilized by professional, college, and scholastic basketball and football teams. It may also be utilized by the owners' and operators of tennis facilities and health clubs and offered as a courtesy to players, members, etc. This system may be easy to use, convenient, practical, performance-enhancing, and durable for years of effective use.

The information disclosed herein is provided merely to illustrate principles and should not be construed as limiting the scope of the subject matter of the terms of the claims. The written specification and figures are, accordingly, to be regarded in an illustrative rather than a restrictive sense. Moreover, the principles disclosed may be applied to achieve the advantages described herein and to achieve other advantages or to satisfy other objectives, as well.

What is claimed is:

1. A system to dry the hands of individuals, the system comprising:

a pedestal;

an air pedal hinged to the pedestal;

a powder pedal hinged to the pedestal;

a chamber having a shroud connected below and to a dome to define a chamber interior, where the shroud is an annulus shaped ring that includes a left hand hole, a right hand hole, and a partition, where the left hand hole and the right hand hole each are openings in the shroud through which a person's hands may be inserted and where the partition is position vertically to divide the chamber interior into a first divided area and a second divided area that correspond to the left hand hole and the right hand hole, respectively, and into an overhead area beneath the dome that connects the first divided area and the second divided area;

a left tube positioned in the first divided area;

a right tube positioned in the second divided area;

a tower positioned between the pedestal and the chamber;

an air compressor connected to the air pedal, the powder pedal, a first air hose, and a second air hose, where the first air hose is connected to the left tube and the right tube and the second air hose is connected to a powder container, where the powder container is configured to store powder to be delivered through the left tube and the right tube into chamber interior, and where the air pedal and the powder pedal are foot controlled and configured to operate an on/off state of the air compressor; and an air regulator connected between the powder container and the left tube and the right tube.

2. The system of claim 1, where the air pedal causes the air compressor to blow air into the first air hose when pressed and the powder pedal causes the air compressor to blow air into the second air hose when pressed.

3. The system of claim 1, where at least one of the left tube and the right tube have a U-shape when viewed from a first direction and a semi-circular shape when view from ninety degrees to that first direction.

4. The system of claim 1, where the left hand hole and the right hand hole each are openings in the shroud positioned above the air pedal and the powder pedal, respectively.

5. The system of claim 1, where a height of the partition is greater than a height of the shroud.

6. The system of claim 1, where both the air pedal and the powder pedal are spring loaded levers that are configured to be operated by a human foot, where the air pedal includes a large "A" on a visible surface and the powder pedal includes a large "P" on a visible surface to distinguish an operation of each pedal.

7. The system of claim 6, further comprising:

casters attached to a bottom of the pedestal, where there are four casters and each caster includes a locking brake.

8. The system of claim 7, where the air compressor is connected to an electric box and a pressure gage, where the electrical box is 110-volt electrical box contained within pedestal and is connected to a power cord.

9. The system of claim 6, where each of the left tube and the right tube is a hollow cylindrical conduit having perforations distributed along its length.

10. The system of claim 9, where the left hand hole and the right hand hole each are rectangular openings.

11. The system of claim 10, where the air compressor is a ½-horsepower air compressor and the first air hose and second air hose each are ¼-inch diameter flexible hoses.

12. The system of claim 11, where the system has a height that is approximately three to four feet and a diameter that is approximately twelve to eighteen inches and where the dome is a clear concave shape with the concavity facing downward.

13. A method to dry the hands of individuals with a system, the method comprising:

presenting a system having a pedestal, an air pedal hinged to the pedestal, a powder pedal hinged to the pedestal, a chamber having a shroud connected below and to a dome to define a chamber interior, where the shroud is an annulus shaped ring that includes a left hand hole, a right hand hole, and a partition, where the left hand hole and the right hand hole each are openings in the shroud through which a person's hands may be inserted and where the partition is position vertically to divide the chamber interior into a first divided area and a second divided area that correspond to the left hand hole and the right hand hole, respectively, and into an overhead area beneath the dome that connects the first divided area and the second divided area, a left tube positioned in the first divided area, a right tube positioned in the second divided area, a tower positioned between the pedestal and the chamber, an air compressor connected to the air pedal, the powder pedal, a first air hose, and a second air hose, where the first air hose is connected to the left tube and the right tube and the second air hose is connected to a powder container, where the powder container is configured to store powder to be delivered through the left tube and the right tube into chamber interior, where the air pedal and the powder pedal are foot controlled and configured to operate an on/off state of the air compressor, and an air regulator connected between the powder container and the left tube and the right tube;

activating the air compressor from the air pedal to force air through both the first air hose and the left tube and the right and into the first divided area and the second divided area; and activating the air compressor from the powder pedal to force air through the second air hose and into the powder container.

14. The method of claim 13, further comprising:

regulating the pressure of air leaving the powder container with the pressure regulator.

* * * * *